US007267243B2

(12) United States Patent
Steg

(10) Patent No.: US 7,267,243 B2
(45) Date of Patent: Sep. 11, 2007

(54) CONTAINER

(75) Inventor: Henning Steg, Tyresö (SE)

(73) Assignee: ARTA Plast AB, Tyresö (SE)

( * ) Notice: Subject to any disclaimer, the term of this patent is extended or adjusted under 35 U.S.C. 154(b) by 321 days.

(21) Appl. No.: 10/637,809

(22) Filed: Aug. 8, 2003

(65) Prior Publication Data

US 2004/0222227 A1 Nov. 11, 2004

(30) Foreign Application Priority Data

May 7, 2003 (EP) ..... 03010270

(51) Int. Cl.
*B65D 41/00* (2006.01)
*B65D 17/34* (2006.01)

(52) U.S. Cl. ..... 220/359.4; 220/270; 220/359.2

(58) Field of Classification Search .. 220/359.1–359.4, 220/780, 793, 805, 270; 215/232, 305
See application file for complete search history.

(56) References Cited

U.S. PATENT DOCUMENTS 3,394,861 A * 7/1968 Truax ..... 229/120.07
3,946,871 A * 3/1976 Sturm ..... 220/359.2
4,044,941 A * 8/1977 Knudsen ..... 220/258.3
4,101,047 A * 7/1978 Geppert et al. ..... 220/258.3
4,215,797 A * 8/1980 Chen ..... 220/359.4
4,595,117 A * 6/1986 Walter ..... 220/359.3
4,605,142 A * 8/1986 Itoh et al. ..... 220/359.4
4,693,390 A * 9/1987 Hekal ..... 220/270
6,460,720 B1 * 10/2002 Massey et al. ..... 220/359.1
6,544,613 B1 * 4/2003 Varadarajan ..... 428/36.9
6,688,486 B2 * 2/2004 Diamond et al. ..... 220/785

* cited by examiner

*Primary Examiner*—Anthony D. Stashick
*Assistant Examiner*—James Smalley
(74) *Attorney, Agent, or Firm*—Klaus J. Bach

(57) ABSTRACT

In a container for solid, paste-like and flowable products, particularly for containing food products, comprising a container bottom part for containing the products, a container lid provided at its top with a foil which is removable to facilitate removal of the container lid, is supported on a flange of the container bottom part, which flange has an upwardly projecting portion extending around the container opening to which the container lid is removably connected.

12 Claims, 4 Drawing Sheets

CONTAINER

BACKGROUND OF THE INVENTION

The invention relates to a container for solid, paste-like, particulate and flowable products, particularly for food products, comprising a container bottom part for containing the products and a top part in the form of a container lid which includes a removable foil for opening the container closed by the container lid.

Such containers, which consist generally of plastic material and which are generally manufactured by injection molding, are commercially available for various applications and in various sizes. They are used in many shapes for all kinds of products, which are to be packaged hygienically, that is, in a sterilized fashion. Products, which are offered packaged in such containers in food stores are, for example, all types of milk products, meat and sausage products, but also vegetable and fruit products and prepared meals in refrigerated and non-refrigerated form.

Since such containers are mass-produced and are to contain the products referred to above in a hygienically, sterilized and air-tight fashion, their manufacture must be inexpensive to be acceptable in the marketplace, that is, to be used by the producers of the products and acceptable to the consumers. Furthermore, such containers have to satisfy various legal regulations concerning information as to the content, the composition of the product, the energy content of the product as well as information regarding manufacturing and expiration data. In certain countries, also information concerning compatibility of the product in the container etc. must be provided.

For this reason, such containers are usually provided with separate labels, which exhibit such information and other parameters which concern the product and are of interest to the consumer. Often, the name of the manufacturer and special trademarks are shown on the labels and the product contained within is depicted on the label, for example, the sausage product, the cheese product, a liver paté or similar products.

The separate labels have the disadvantage that the production costs are increased since, after the product has been filled into the container and the container has been closed, the label has to be applied to the container, the container lid, or to the container as well as to the container lid.

Another serious problem with such containers is the fact that upon opening of the container by removing of the lid, which is formed in the well-known yogurt and cottage cheese containers for example by an aluminum foil, the lid is not released at its edge areas but it is ripped so that the container can no longer be closed, not even provisionally, for storing any product remaining in the container. In another closure of such containers wherein an imprinted foil has been applied to the lid thereof, the foil may separate from the container lid when it is tried to open the lid while the connection between the container lid and the container remains intact that is the container cannot be opened in the way it is intended to be opened.

A third type of a container is known wherein, during the manufacture of the container lid in accordance with the method of the so-called "immobilized label" (IML), the foil, which forms the outer surface of the container lid is joined to the lid already in the injection molding tool and an outer edge area of the foil, which radially projects over the container lid, is connected to the container. But also, this type of container has the disadvantage that the foil area which is not reinforced at its outer circumference is ripped off during opening of the container in an uncontrolled manner so that, in the end, the container can finally be opened only by using some tool such as scissors or a knife. Of course, such a container lid cannot again be properly mounted so as to seal the container, not even provisionally, to protect any food still left in the container. Another disadvantage resides in the fact that, upon opening such a container, often spillage occurs whereby the consumers or users themselves are soiled.

It is therefore the object of the present invention to provide a container of the type described above, which however does not have the disadvantages mentioned, that is, which is easy to open and, during opening of the container, the foil is not ripped off and is not damaged by the removal of the container lid, or, respectively, the top part of the container from the bottom part of the container, so that the lid can still be used for closing the container when, upon first opening the container, the product is not completely removed. The container should also be relatively inexpensive to manufacture and be usable for various packaging purposes.

SUMMARY OF THE INVENTION

In a container for solid, paste-like and flowable products, particularly for containing food products, comprising a container bottom part for containing the products, a container lid provided at its top with a foil which is removable to facilitate removal of the container lid is supported on a flange of the container bottom part, which flange has an upwardly projecting portion extending around the opening of the container bottom part to which the container lid is removably connected.

The container according to the invention has the advantage that the top part of the container, which forms the container lid and which is provided with a foil that can be cleanly removed from the projecting rim of the bottom part of the container and only the projecting rim form the mounting area between the top part of the container and the bottom part of the container. The foil may be so dimensioned that, depending on the type of material of which the container bottom and top parts and the foil mounted on the container top part consist, the ripping or rolling off of the foil during opening of the container is avoided and also rupture of the container lid during opening of the container, which would render the container lid useless, is avoided by a loosening of the jointure between container bottom and top parts. The area of jointure between the bottom and top parts of the container does not require any particular tools because of the effective design of the connection structure, so that the container can be manufactured in a cost-effective manner.

In an advantageous embodiment of the invention, the rim is tongue-shaped in cross-section for providing a groove-and-tongue-like joint. The rim, which is used for establishing the connection with the container top part, is formed by the upper surface of the tongue, which extends to a plane coinciding with the container lid top surface. In this way, the surface area of the tongue provides the joint area with the container lid.

In another advantageous embodiment, the container bottom part is provided in the area of its opening with a flange-like circumferential first collar on which the rim, or respectively, the tongue mentioned above are formed. With this embodiment, the container lid may be supported on the flange-like first collar, which provides for the connection with the bottom part by way of the rim or, respectively, the tongue.

Depending on the form of the container which can be as desired, it may be advantageous if the first collar is so formed that it projects outwardly from the container bottom part at a right angle. In this way, support of the container lid on the lower container part is provided in simple manner.

In order to increase the form stability of the container, which generally consists of a thin plastic wall, the lower container part includes a second collar which is disposed at the outer end of the first collar and which extends essentially at a right angle therefrom. With this arrangement, containers filled with products can easily be stacked on top of one another, for example, on display shelves in food stores, etc . . . without the containers sliding off one another. Furthermore, the second collar provides for an additional guide structure for the container lid when it is inserted into the opening formed by the first and second collars for the connection of the container lid with the lower container part. As a result, for the connection between the upper container part and the lower container part, no particular fixing measures are needed.

In still another embodiment of the invention the second collar includes a cut-out extending down to the first collar through which access is provided for a user to permit grasping, with the fingers, the container lid for removing it from the lower container part.

Generally, the container lid is a flat element, but depending on the product to be contained in the container, the container lid may have a different shape.

In order to provide on the container lid a jointure surface corresponding to that of the lower container part the container lid is provided near its outer edge area with a circumferential recess for receiving a fitting circumferential projection of the flange of the lower container part so that the recess forms a guide means receiving the projection on the collar of the lower container part. The projection on the collar of the lower container part is in the form of a tongue and the recess in the container lid is in the form of a groove for forming a groove and tongue joint wherein the groove of the container lid receives the tongue of the lower container part for guided joining of the lower container part and the container lid. Such guidance also facilitates re-closing the container after it has been opened and the product contained in the container has not been fully removed.

In accordance with another advantageous embodiment of the container, the bottom, that is the inner end wall of the recess in the container lid is formed only by a foil disposed on top of the container lid so that the connection between the container lid and the lower container part is formed between the foil of the container lid and the material of the rim of the lower container part which is usually the same as the material of which the lower container part consists. With the foil which at the container lid forms the connecting element or connecting area, upon opening of the container, that is, upon removal of the container lid, the foil is removed, in a well-defined manner, from the connecting area with the lower container part without any damage to the upper or, relatively lower container parts.

The provision of a circumferential web directed facing the lower container part which forms actually an extension of the container lid adjacent the lower container part improves the jointure of the container lid with the lower container part.

In order to provide for a adaptation of the foil on the container lid toward the rim when the foil is connected to the lower container part, it is advantageous if the upper container part extends beyond the recess toward the rim, and the recess is only interrupted by the circumferential depression in the container lid which is in the form of a groove.

Such an extension that is the extension of the circumferential rim beyond the recess, may further be provided with notches in the outer area of the container top, which form a weakened structure permitting bending. In this way, the strip can be easily bend when grasped by the user between finger and thumb for opening, that is removing the upper container part. Bending occurs along the notches so that the likelihood of the foil being ripped off the upper container part, that is, the container lid is reduced.

Finally, the foil is so arranged that, in the area of the cut-outs, it projects beyond the edge of the container lid so as to form a gripping edge which can be easily grasped by the user and pulled upwardly and by bending the container lid along the grooves, can be pulled in the opening direction of the container lid whereby the container lid is disconnected from the lower container part.

The connection between the upper container part and the container lid may be provided for in any suitable manner taking into consideration however, the necessary hygiene, sterility, sealing, moisture and air admission. It is particularly advantageous to join the container lid to the lower container part by melt-welding since a hygienic air-and-moisture-tight and sterile connection can be established in this way in a simple manner.

The invention will be described below in greater detail on the basis of the accompanying drawings.

DESCRIPTION OF PREFERRED EMBODIMENTS

Figure 1:
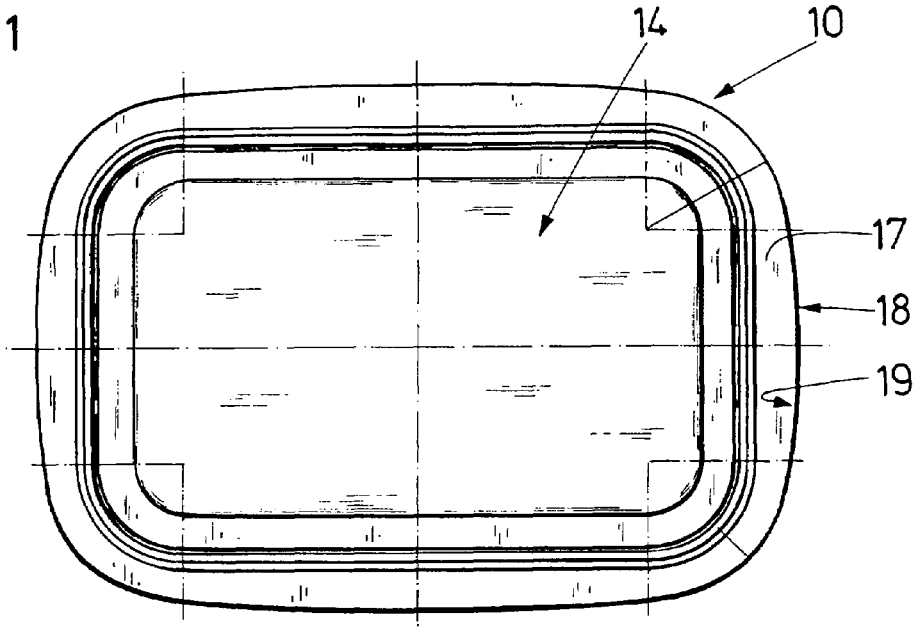
FIG. 1 is a top view of a lower container part.
Figure 2:
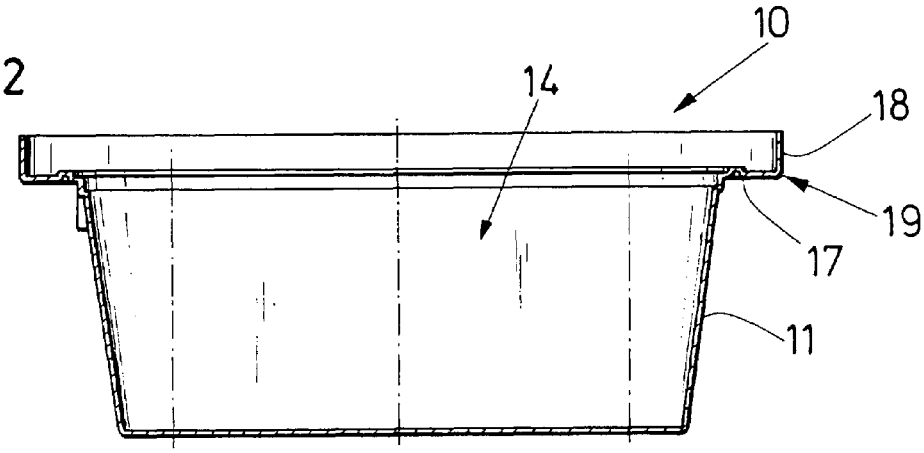
FIG. 2 is a side view of the container lid.
Figure 3:
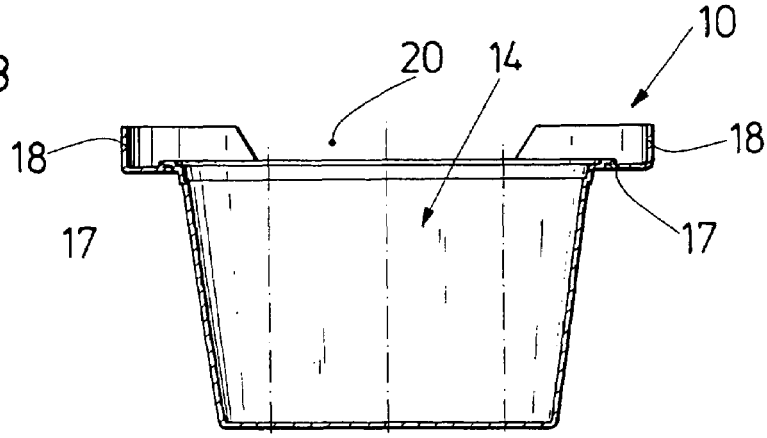
FIG. 3 is a front view of the lower container part showing a cutout for accommodating a grasping flap, which is not shown.

First, reference is made to FIGS. 1 to 3, which show the lower part 11 of the container 10. The container 10 is intended to receive solid, paste-like as well as flowable and particulate products, particularly food products, which are contained in the lower container part 11. These containers are generally known as yogurt containers of plastic material or as containers for other milk products such has butter and cheese and for meat products such as lever paté etc. Since the basic design of such containers 10 is well known only specific details need to be clearly described for an understanding of the invention.

The lower container part 11 has a container opening 14, which is surrounded by a flange-like circumferential first collar 17, which projects essentially rectangularly from the lower container part 11. The lower container part as shown herein has slightly conical side-walls so that the angle between the collar 17 and the side-walls of the container is slightly different from 90°. The lower container part 11 includes furthermore a second collar 18, which is disposed at the free outer end 19 of the first collar 17. The second collar 18 (FIG. 3) includes a cut-out 20, which extends downwardly to the first collar 17. The cutout 20 is adapted to accommodate a grasping flap 28, see FIGS. 4 and 5, as will be described below in greater detail.

Figure 4:
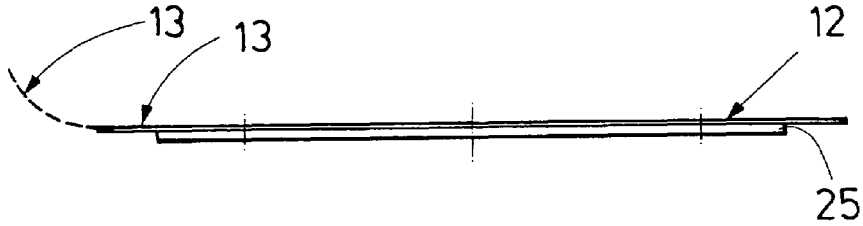
FIG. 4 is a side view of the container lid.
Figure 5:
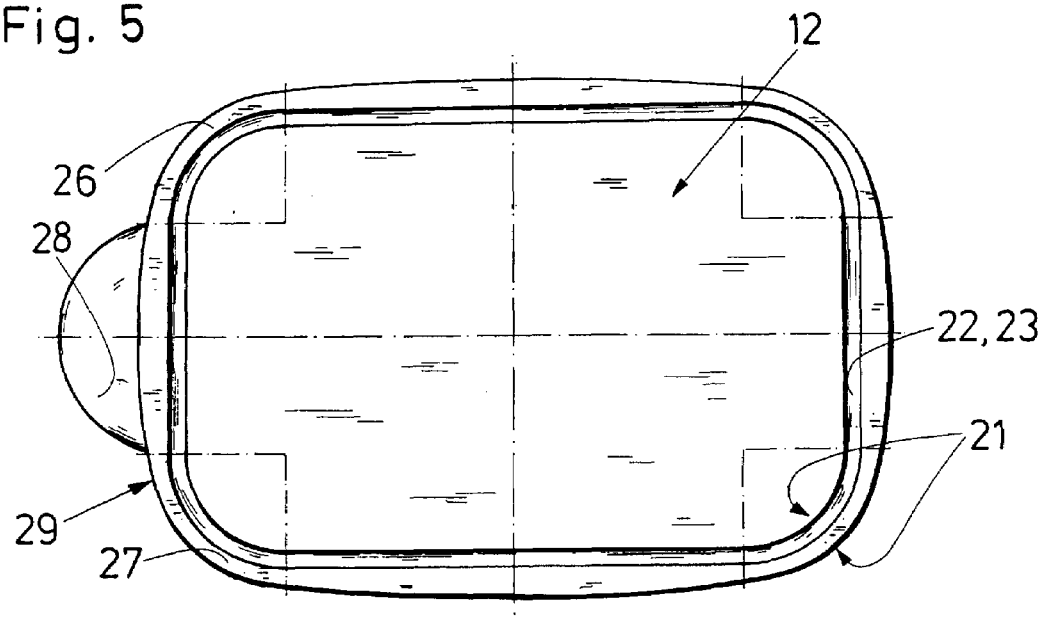
FIG. 5 is a bottom view of the lower container part.

FIGS. 4 and 5 show the upper container part or lid 12 which forms, together with the lower container part 11 shown in FIGS. 1 to 3, the container 10 according to the invention. The container lid 12 is provided with a foil 13, which is connected to the container lid during injection molding by the known principle of "immolded label" (IML) procedure. The upper container part or lid 11 is essentially a planar element as shown in FIG. 4.

Figure 6:
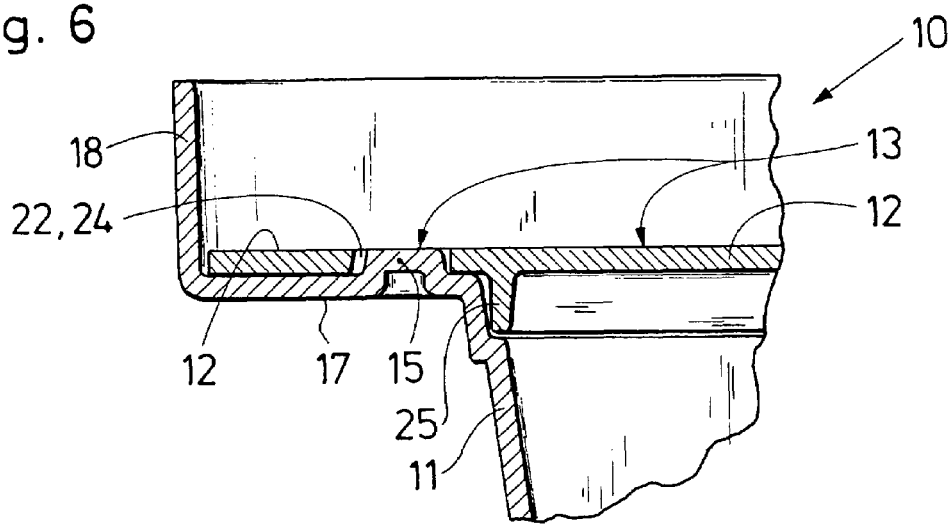
FIG. 6 shows a detail of the closing area of the container lid and the lower container part in an enlarged representation.
Figure 7:
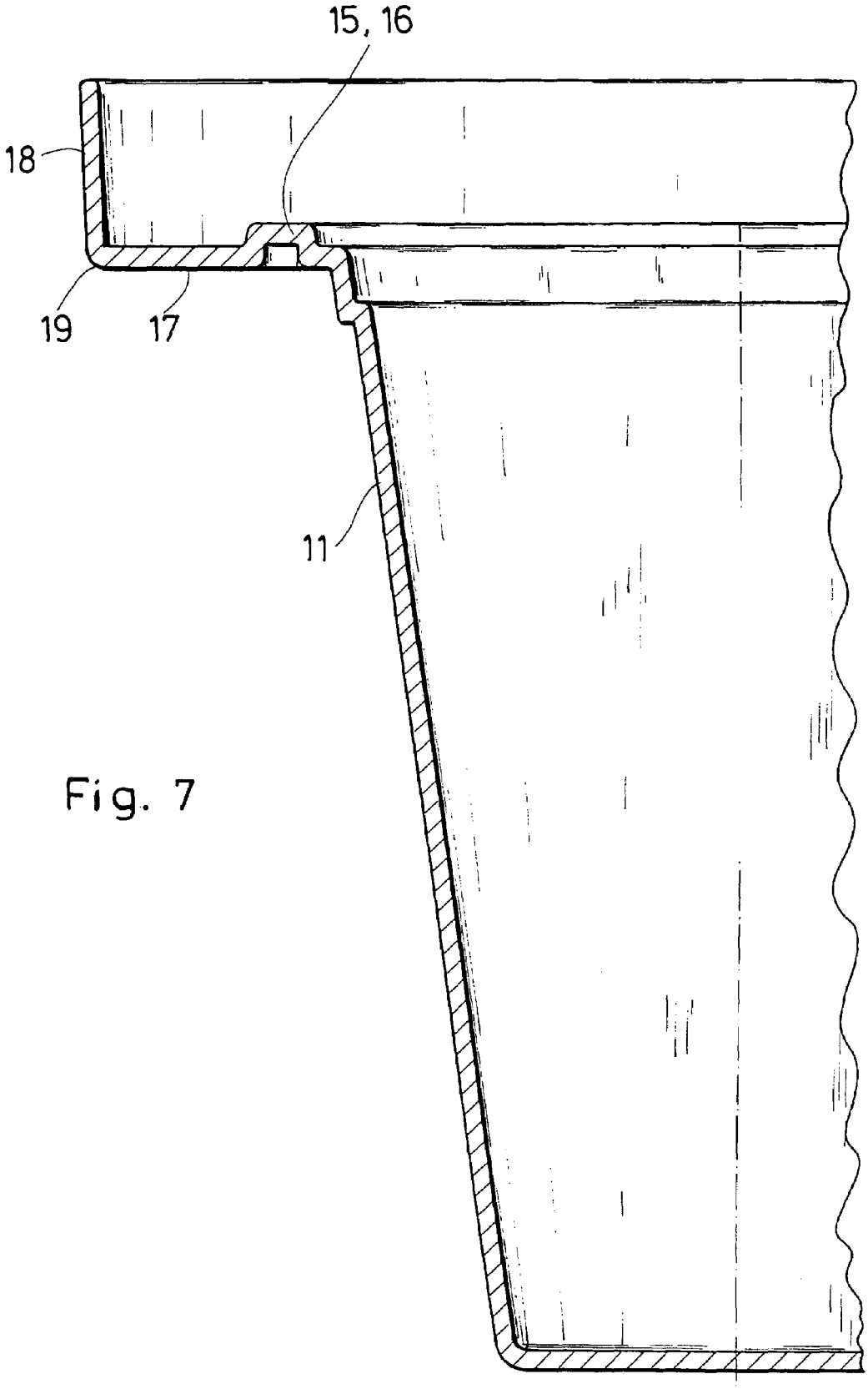
FIG. 7 is an enlarged view of the lower container part, similar to that of FIG. 6, but without the container lid.

The container lid 12 includes a circumferential rim area 21, which is provided with a circumferentially extending recess 22 in the form of a groove 23. The bottom of the recess 22, see FIG. 6, is formed by the foil 13 disposed on the container lid 12. At its bottom side, the container lid 12 is provided with a web 25, see FIGS. 4 and 6, which projects downwardly toward the bottom part of the container. The web 25 extends completely around the container lid 12 at the bottom side thereof as it is shown schematically in FIGS. 5 and 6.

The foil 13 is provided with a grasping flap 28, which consists of the same material as the foil 13 that is, it is practically an extension of the foil 13 projecting beyond the edge area 21 of the lid 12. The grasping flap 28 extends through the cutout 20, shown in FIG. 3.

Figure 8:
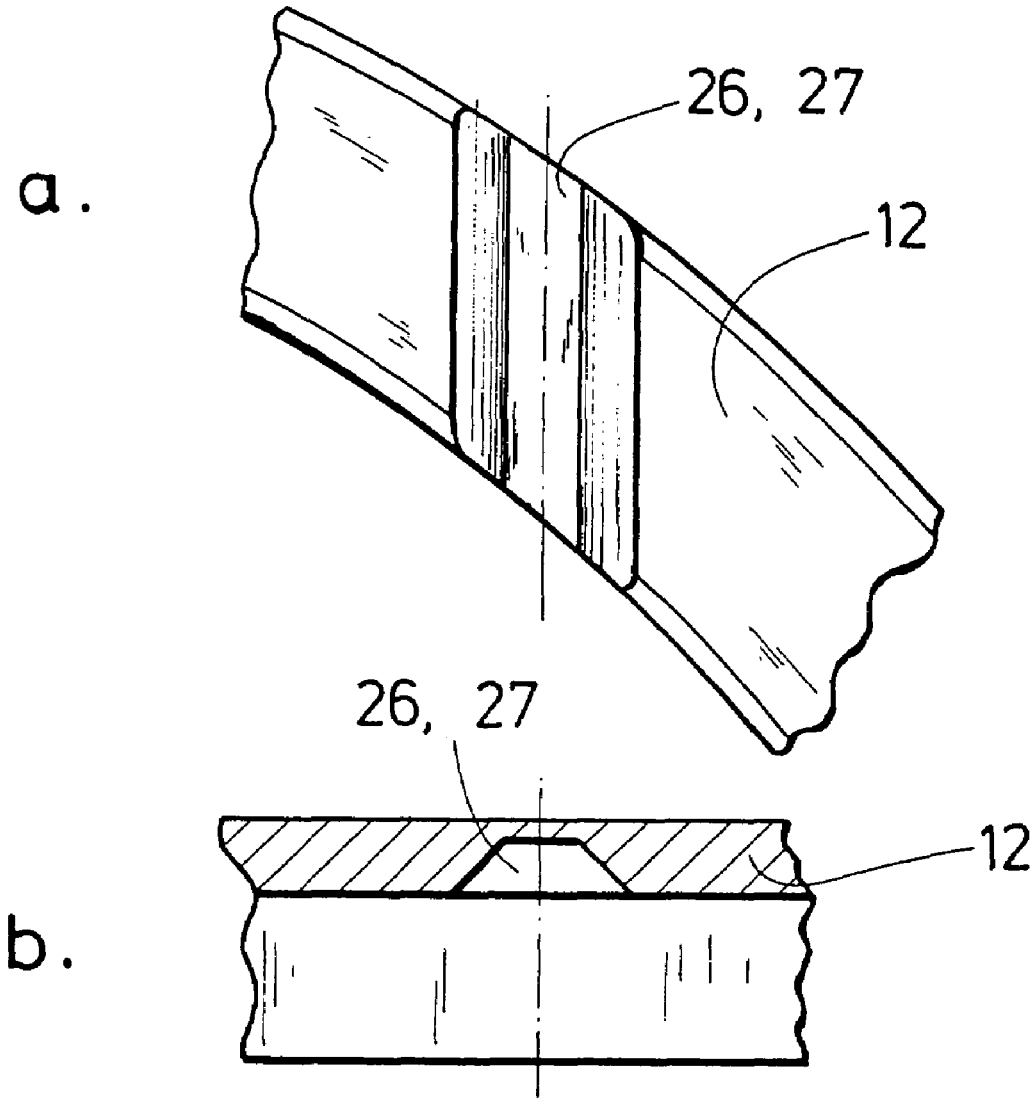
FIG. 8*a* is a detail view of an edge area of the container lid showing a recesses area.
FIG. 8*b* shows the area of FIG. 8*a* in a cross-sectional view.

The outer edge area of the container lid 12, see FIG. 6, includes at least two opposite recesses 26, 27; see FIG. 5 and FIGS. 8*a* and 8*b*, which show the recesses 26, 27 in detail.

The container bottom part 11, see FIGS. 1-3 and 6 and 7, includes a flange-like first collar 17 with an upward projection 15. The upward projection 15 is in the form of a tongue 16, whereas the recess 22 is in the form of a groove 23, as noted above. The inner bottom wall 24 of the groove 22 is formed by the foil 13 as already pointed out in the description of the container 10. The actual connection between the container lid 12 and the lower container part 11 is established between the top surface of the projection 15 that is the tongue 16, and the container lid top, which is formed in this area by the foil 13. The connection may be established in various ways for example by a melt-weld connection, by ultrasound welding or by the use of special connecting means.

For opening the container 10, the container lid 12 is grasped at the grasping flap 28 between the finger and the thumb, see FIGS. 4 and 5, and moved toward the right with respect to the representation of FIGS. 4 and 5. As a result, in the container embodiment shown and described herein, the container lid 12 is first disconnected from the narrow side of the lower container part 11, see FIG. 3, and, with further pulling of the grasping flap 28 to the right, the foil is lifted over the total area of the container opening whereby the container 10 is then opened.

The recesses 26, 27 facilitate a non-destructive lifting of the container lid 12 since the container lid is weakened in these areas which is desirable to permit bending and to facilitate the lifting of the container lid 12. The rupture of the foil 13 is on one hand avoided in this manner that is the foil remains joined to the container lid 12 during the process and the projection 15 and the groove 22 are not damaged so that, afterward, the container lid 12 can be used again for a provisional closing of the container opening 14 if part of the product remains in the container.

What is claimed is:

1. A container (10) for solid, paste-like and flowable products, particularly for containing food products, comprising: a container bottom part (11) with a container opening (14) for containing said products, a container lid (12) provided at its top with a foil (13), which is removable for opening the container (10), said container bottom part (11) having a circumferential flange (17) with an upwardly projecting portion (15) extending around the container opening (14) to which the container lid (12) is removably connected, said container lid (12) including a center part and a circumferential rim area (21) joined by the foil (13) so as to form therebetween a recess (22) for receiving said upwardly projecting portion (15) of the container bottom part (11), said recess (22) having a bottom wall (24), which is formed by said foil (13) disposed on said container lid (12) and attached to said upwardly projecting portion (15) of the circumferential flange (17), said foil (13) being removable for opening the container (10) whereby the center part of the lid (13) covering the container opening (14) remains as a replaceable container cover for closing the container opening (14).

2. A container according to claim 1, wherein said upwardly projecting portion (15) in cross-section is in the form of a tongue (16).

3. A container according to claim 2, wherein the container bottom part (11) includes a flange like first collar (17) which extends around the container opening (14) and on which said projecting portion (15) is disposed.

4. A container according to claim 3, wherein said first collar (17) extends from the container bottom part (11) essentially at a right angle.

5. A container according to claim 3, wherein said container bottom part (11) includes a second collar (18) extending around the outer end of the first collar (17) essentially at a right angle to the first collar (17).

6. A container according to claim 5, wherein said second collar (18) includes at least one cut-out (20) extending to the first collar (17).

7. A container according to claim 1, wherein said container lid (12) is essentially a planar element.

8. A container according to claim 1, wherein said circumferential recess (22) is in the form of a groove.

9. A container according to claim 1, wherein said container lid (12) is provided with a circumferential web (25) projecting toward the lower container part (11).

10. A container according to claim 1, wherein the container lid (12) has an outer nut area (21) which adjacent said recess (22) is provided with opposite grooves (26, 27) facilitating removal of the container lid (12).

11. A container according to claim 5, wherein the second collar (18) has cutouts (20) and said foil (13) has grasping flaps (28) projecting from the container lid (12) through said cut-outs (20).

12. A container according to claim 1, wherein said container lid (12) is connected to the lower container part (11) by a melt-weld connection.

* * * * *